US010274209B2

(12) United States Patent
Sato et al.

(10) Patent No.: US 10,274,209 B2
(45) Date of Patent: Apr. 30, 2019

(54) AIR CONDITIONER AND INDOOR UNIT OF THE SAME

(71) Applicant: Johnson Controls-Hitachi Air Conditioning Technology (Hong Kong) Limited, Hong Kong (CN)

(72) Inventors: Daiwa Sato, Tokyo (JP); Kazuhiro Tsuchihashi, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 159 days.

(21) Appl. No.: 15/220,593

(22) Filed: Jul. 27, 2016

(65) Prior Publication Data

US 2017/0074525 A1 Mar. 16, 2017

(30) Foreign Application Priority Data

Sep. 11, 2015 (JP) ..... 2015-179564

(51) Int. Cl.
*F24F 13/06* (2006.01)
*F24F 1/0022* (2019.01)
*F24F 1/0047* (2019.01)

(52) U.S. Cl.
CPC ..... *F24F 1/0022* (2013.01); *F24F 1/0047* (2019.02); *F24F 2013/0616* (2013.01)

(58) Field of Classification Search
CPC ..... F24F 1/0022; F24F 2001/0037; F24F 2013/0616; F24F 13/06; F24F 13/24; F24F 2221/14; F24F 13/08; F04D 29/4226; F04D 29/663; F04D 29/66
USPC ..... 62/428
See application file for complete search history.

(56) References Cited

U.S. PATENT DOCUMENTS

2001/0037874 A1* 11/2001 Hata ..... F24F 1/0007 165/53
2008/0035317 A1* 2/2008 Choi ..... F24F 1/0007 165/122
2016/0223211 A1* 8/2016 Xue ..... F24F 1/0022

FOREIGN PATENT DOCUMENTS

JP 3581926 B2 10/2004
JP 2014109386 A * 6/2014
JP 2014129994 A * 7/2014

* cited by examiner

*Primary Examiner* — Joseph F Trpisovsky
(74) *Attorney, Agent, or Firm* — Mattingly & Malur, PC

(57) ABSTRACT

The present disclosure provides an indoor unit of an air conditioner includes a housing, a centrifugal fan arranged inside the housing, and a heat exchanger arranged so as to surround the centrifugal fan, in which the heat exchanger includes an area cut in a direction of rotation of the centrifugal fan. A current plate provided at a final portion of the heat exchanger in the direction of the rotation of the centrifugal fan includes a first face which is extended in a height direction of the heat exchanger and blocks an air flow produced between the centrifugal fan and the heat exchanger and a second face protruded from the first face in a direction opposite the air flow. The indoor unit has an advantageous effect to suppress an inflow of air to a space where the heat exchanger is cut in the indoor unit to reduce the power consumption.

5 Claims, 15 Drawing Sheets

AIR CONDITIONER AND INDOOR UNIT OF THE SAME

CLAIM OF PRIORITY

The present application claims priority from Japanese Patent application serial No. 2015-179564, filed on Sep. 11, 2015, the content of which is hereby incorporated by reference into this application.

BACKGROUND OF THE INVENTION

Field of the Invention

The present invention relates to an air conditioner and its indoor unit.

Description of Related Art

The publicly known technologies in the art include Japanese Patent No. 3581926 (Patent Document 1). Patent Document 1 discloses an air conditioner (an indoor unit) installed in a ceiling and including a centrifugal blower paced in a casing and a heat exchanger arranged so as to surround the centrifugal blower. Part of the heat exchanger has a separated portion and a rectification member is provided in an area sandwiched between the separated portion and the circumferential portion of the centrifugal blower opposed to the separated portion for partitioning flow paths.

SUMMARY OF THE INVENTION

An indoor unit of an air conditioner of the present invention includes: a housing; a centrifugal fan arranged inside the housing; and a heat exchanger arranged so as to surround the centrifugal fan, in which the heat exchanger includes an area cut in a direction of rotation of the centrifugal fan. A current plate is provided at a final portion of the heat exchanger in the direction of the rotation of the centrifugal fan. The current plate includes a first face which is extended in a height direction of the heat exchanger and blocks an air flow produced between the centrifugal fan and the heat exchanger and a second face protruded from the first face in a direction opposite the air flow.

According to one aspect of the present invention, it is possible to suppress an inflow of air to a space where a heat exchanger is cut in the indoor unit of the air conditioner to reduce the power consumption of the air conditioner.

The other problems to be addressed by the present invention and the other configurations, actions, and effects of the present invention will be described in details in relation to the following embodiments.

DETAILED DESCRIPTION OF THE PREFERRED EMBODIMENTS

In a heat exchanger arranged in an indoor unit, a refrigerant flows for heat exchange with air. The refrigerant that flowed from an outdoor unit into the indoor unit flows into the heat exchanger arranged in the indoor unit. After exchanging heat with air sent from a centrifugal fan, the refrigerant flows out from the indoor unit toward the outdoor unit again. These operations are performed using a compressor as a driving source. Thus the refrigerant circulates in a pipe connected to the compressor and thereby functions as a heat pump for the air conditioner.

In the housing of the indoor unit, a distributor is arranged together with the heat exchanger for distributing the refrigerant to a connecting pipe required for connecting a pipe extended from the outdoor unit with the heat exchanger arranged in the indoor unit and a plurality of heat transfer pipes. The heat exchanger is cut halfway in a circumferential direction and a distributor and a connecting pipe are placed in this cut space. In the vicinity of such a space, the pressure increases and this impairs the rotational symmetry of a flow of air blown out from the centrifugal fan and prevents predetermined operating characteristics of the centrifugal fan from being obtained; therefore, the production of noise is caused.

In the technology in Patent Document 1, a rectification member is provided in a part of a space (separated portion) where the heat exchanger is cut to uniformize a pressure distribution in the vicinity of the space, thereby suppressing noise.

However, in an area where the heat exchanger is cut, heat exchange with air does not occur and the inflow of air to such an area causes a pressure loss in a distributor or a connecting pipe. As a result, energy is lost and this leads to an increased power consumption. In these circumferences, only an arrangement of a rectification member to uniformize a pressure distribution is insufficient to achieve the reduction of the power consumption.

Consequently, it is an object of the present invention to suppress the inflow of air to a space where a heat exchanger is cut in an indoor unit of an air conditioner to reduce the power consumption of the air conditioner.

Figure 1:
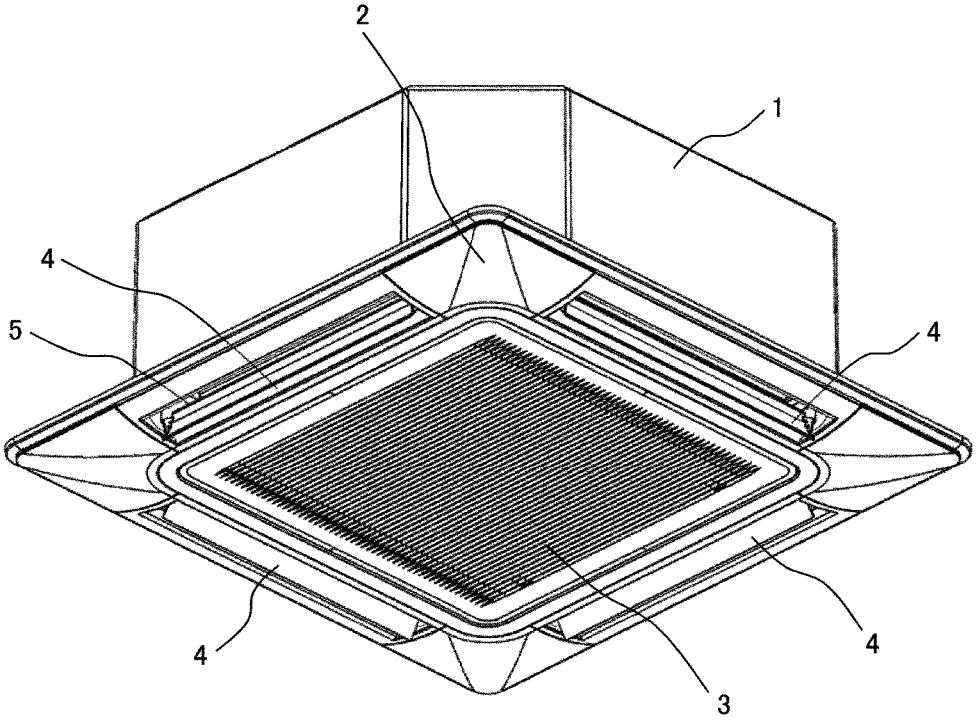
FIG. 1 is a perspective view illustrating an indoor unit of an air conditioner.

FIG. 1 is a perspective view illustrating the appearance of the indoor unit of a common air conditioner.

The indoor unit in FIG. 1 is connected with an outdoor unit (not shown) through a refrigerant pipe and constitutes the air conditioner. The outdoor unit has a compressor arranged therein and a refrigerant is compressed by this compressor and circulates in the refrigerant pipe, a refrigeration cycle being thereby formed.

The indoor unit includes a housing 1 placed in a ceiling and a panel 2 attached to the indoor side of the housing 1. The panel 2 is provided with a grille 3 for taking in air and air outlets 4 provided in four locations for blowing air sucked through the grille 3 out into the room. Each of the air outlets 4 has a louver 5 attached thereto for adjusting a direction of an air blowout.

Figure 2:
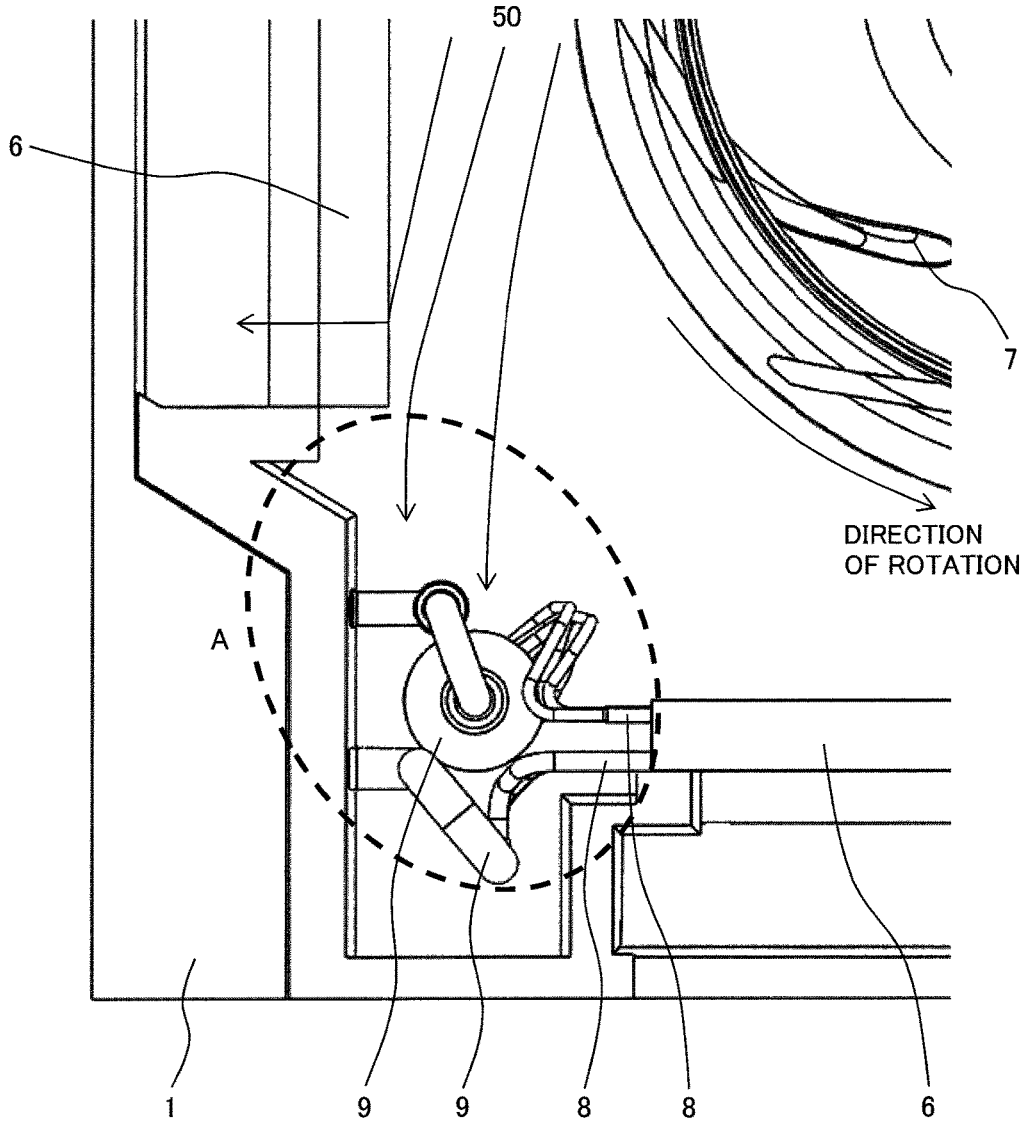
FIG. 2 is a partial enlarged view of FIG. 1.

FIG. 2 is a partial enlarged view of FIG. 1, illustrating the indoor unit as the panel 2 and a drain pan (not shown) for storing water condensed in the heat exchanger during a cooling period are removed therefrom.

As illustrated in FIG. 2, in the housing 1 of the indoor unit, there are arranged a centrifugal fan 7 for discharging air in a circumferential direction, placed in the center of the indoor unit and a heat exchanger 6 placed in an air blowing direction of the centrifugal fan 7 such that the centrifugal fan 7 is surrounded therewith. The heat exchanger 6 performs heat exchange between air from the centrifugal fan 7 and the refrigerant.

The housing 1 is provided therein with a space A which is an area where the heat exchanger 6 is cut in a circumferential direction (a direction of rotation of the centrifugal fan 7). A distributor 9 and a connecting pipe 8 are arranged in this space A. The connecting pipe 8 connects a pipe (not shown) extended from the outdoor unit and the heat exchanger 6 of the indoor unit. The distributor 9 distributes the refrigerant to a plurality of heat transfer pipes. The refrigerant sent from the outdoor unit is supplied to the heat exchanger 6 through the distributor 9 and the connecting pipe 8 and exchanges heat there with air.

As illustrated in FIG. 2, an air flow 50 generated by the rotation of the centrifugal fan 7 does not all flow into the heat exchanger 6 but a part of the air flow enters the space A. In the space A, the connecting pipe 8 and the distributor 9 are arranged and a pressure loss occurs there. As a result, the energy of the air that flowed into the space A is lost and this increases power consumption.

Hereafter, a description will be given to embodiments of the present invention. The indoor units and the air conditioners described in relation to the following embodiments are basically identical in configuration with those illustrated in FIGS. 1 and 2. For this reason, the following description of the embodiments will be given mainly to features of the indoor unit.

First Embodiment

Figure 3:
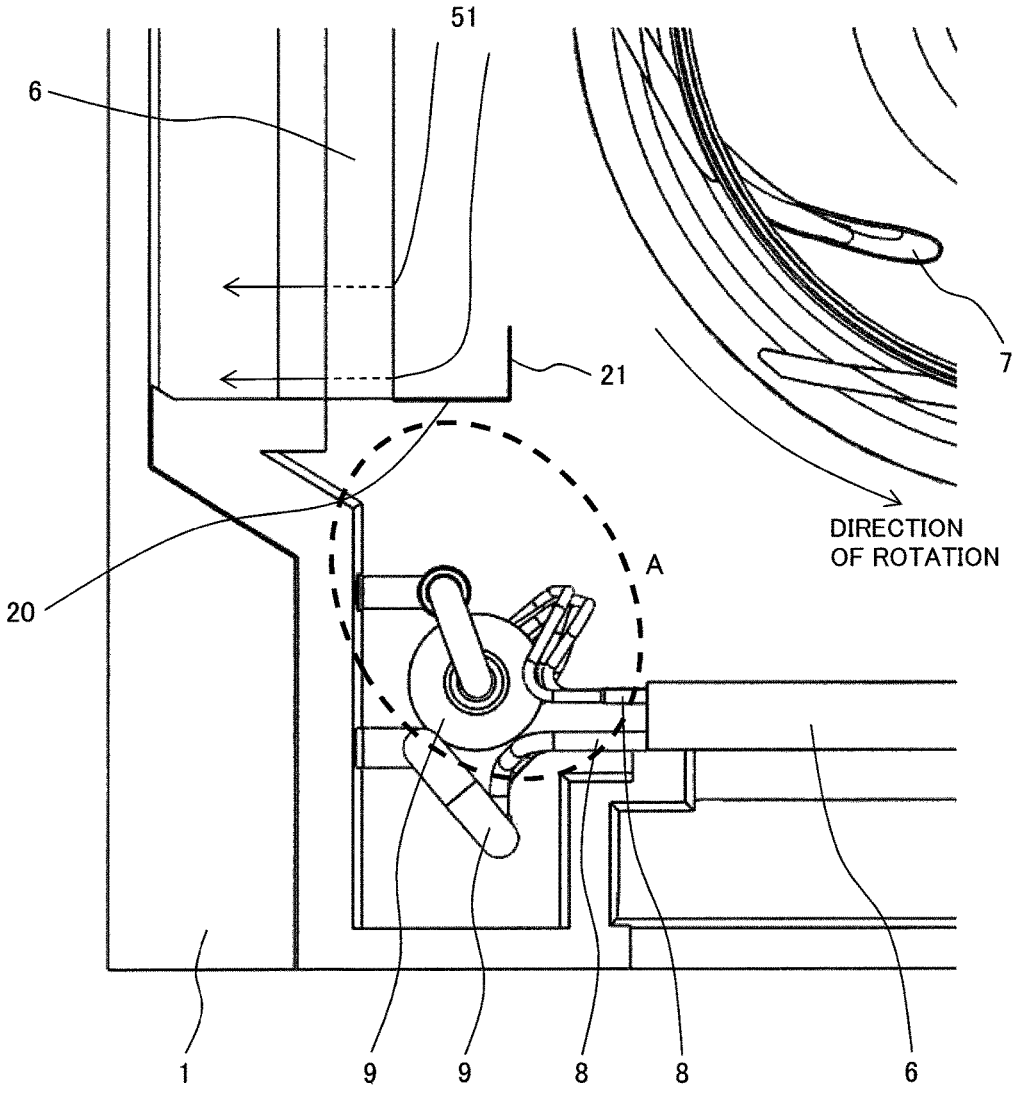
FIG. 3 is a partial enlarged view illustrating an inside of the indoor unit of the air conditioner in a first embodiment.

FIG. 3 illustrates the configuration of the inside of an indoor unit in a first embodiment and a flow field of air sent from the centrifugal fan.

In the first embodiment, as illustrated in FIG. 3, a current plate 20 is provided in a final portion of the direction of rotation of the centrifugal fan 7 of the heat exchanger 6 for promoting the inflow of air sent from the centrifugal fan 7 to the heat exchanger 6. A second face 21 protruded toward the air blowing direction of the centrifugal fan 7 and extended in a height direction of the heat exchanger 6 is attached to the current plate 20 (first face). In other words, as viewed from the side of the panel of the indoor unit, the current plate 20 and the second face 21 are orthogonal to each other and form an L shape. The second face 21 is in such a shape that the second face is opposed to the inner circumferential surface (a face opposed to the centrifugal fan 7) of the heat exchanger 6 and is extended in the height direction of the heat exchanger 6.

When an air flow 51 sent from the centrifugal fan 7 collides with the current plate 20, the air flow is prevented from entering the space A by the second face 21, which further promotes the inflow of air to the heat exchanger 6. As a result, energy which would otherwise be lost by the inflow of air to the space A is not wasted and the inflow to the heat exchanger 6 is promoted. This increases the amount of exchanged heat and thus power consumption can be reduced.

Second Embodiment

Figure 4:
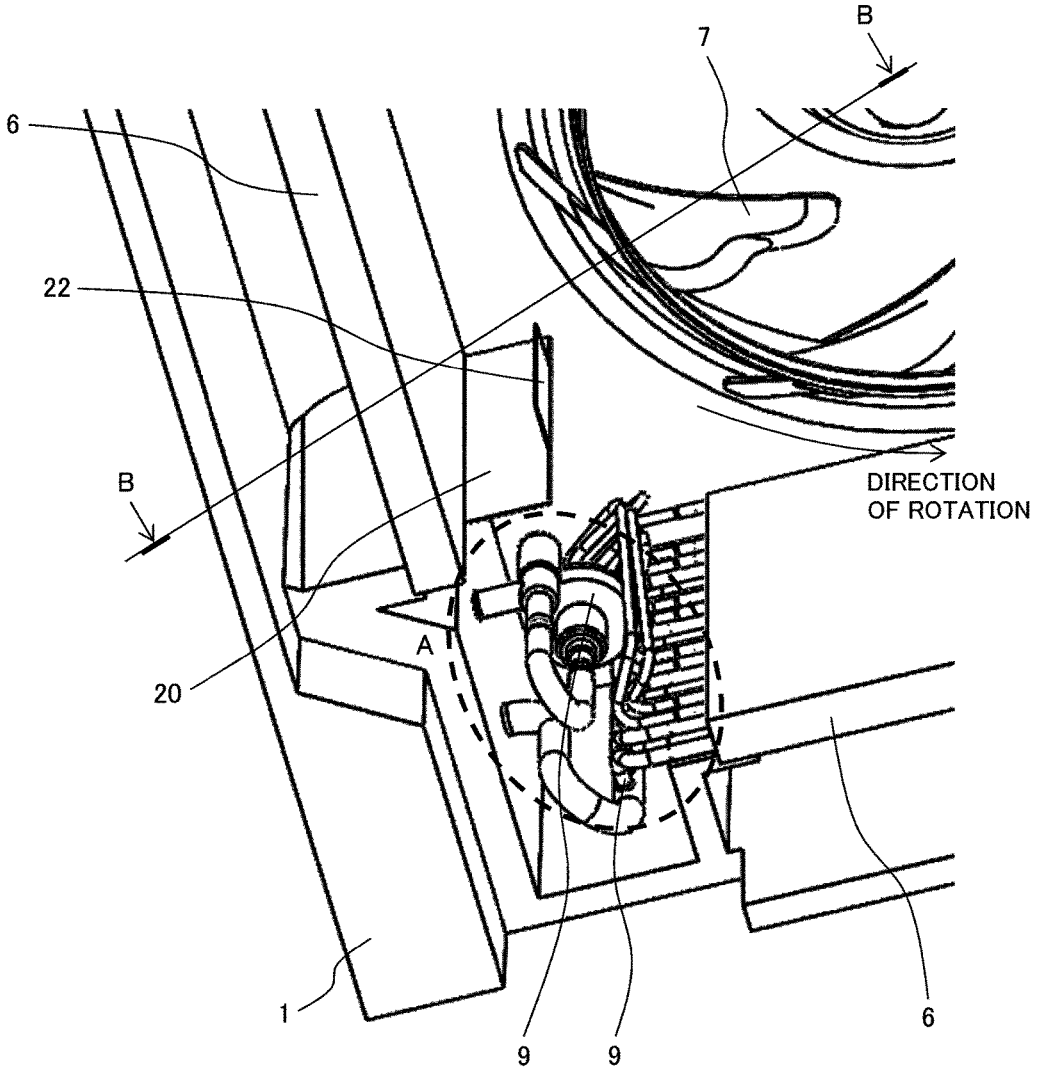
FIG. 4 is a partial perspective view illustrating an inside of the indoor unit of the air conditioner in a second embodiment.

FIG. 4 is a perspective view illustrating the configuration of the inside of an indoor unit in a second embodiment. The height of the second face 21 shown in FIG. 3 need not be equal to the height of the current plate 20 as long as the same effect as in the first embodiment is obtained. When the height of the second face 22 is equal to or larger than at least half the height of a discharge opening 71 of the centrifugal fan 7 and the second face 22 or at least a part of the second face 22 is attached at the same height of the discharge opening 71 of the centrifugal fan 7, the same effect as in the first embodiment is obtained. It is desirable that the height of the second face 22 be identical with the height H of the discharge opening 71 of the centrifugal fan 7 and an attaching position of the second face 22 be identical with that of the discharge opening 71 of centrifugal fan 7. Further, it is also acceptable that the height of the second face 22 be larger than the height H of the discharge opening 71 of the centrifugal fan 7 and the second face 22 be disposed so as to cover the entire area in the height direction of the discharge opening 71.

Figure 5:
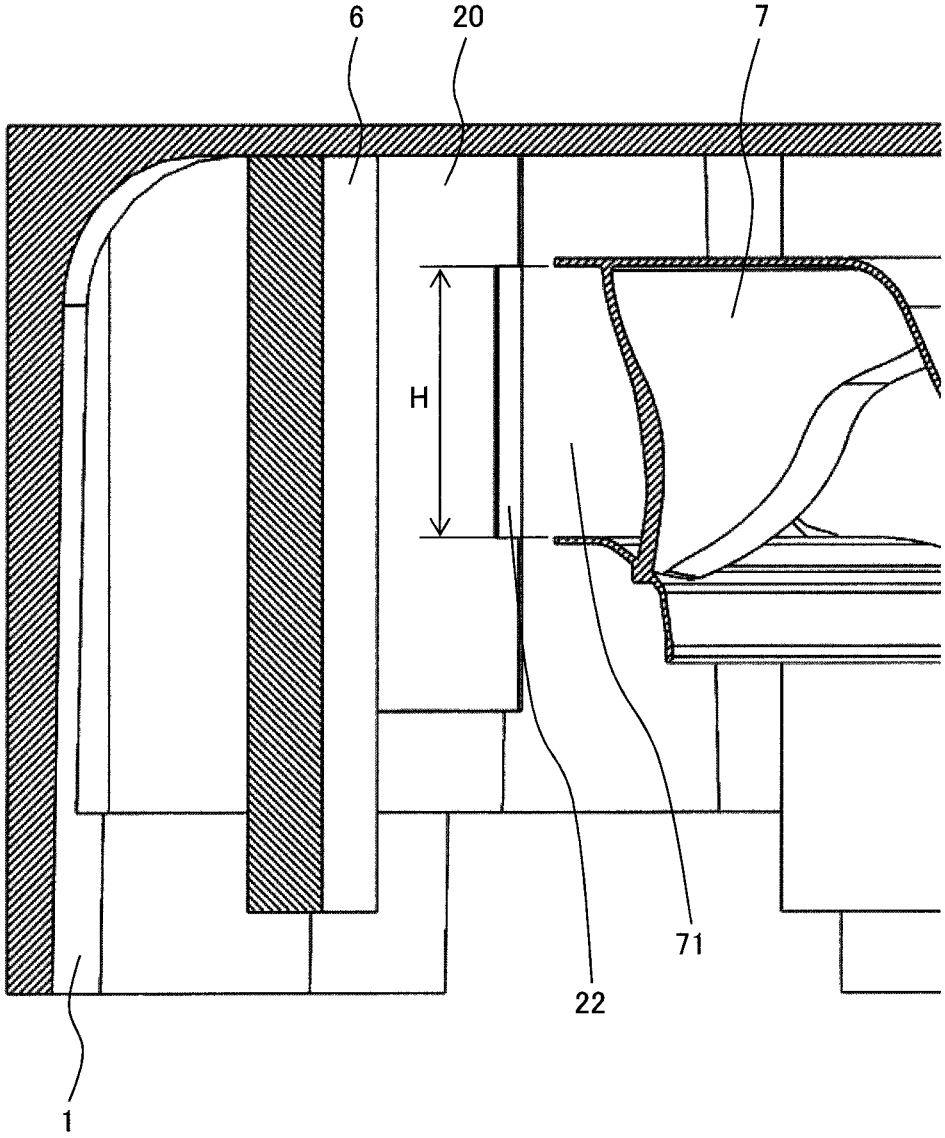
FIG. 5 is a sectional view taken along line B-B of FIG. 4.

FIG. 5 is a sectional view taken along line B-B of FIG. 4.

In FIG. 5, the height of the second face 22 is identical with the height H of the discharge opening 71 of the centrifugal fan 7 and the attaching position of the second face 22 is identical with the position of the discharge opening 71 of the centrifugal fan 7. As a result, the same effect as in the first embodiment is obtained. In addition, since the area of the second face 22 is smaller than the area of the second face 21 in the first embodiment (FIG. 3), the cost of materials can be reduced.

Third Embodiment

Figure 6:
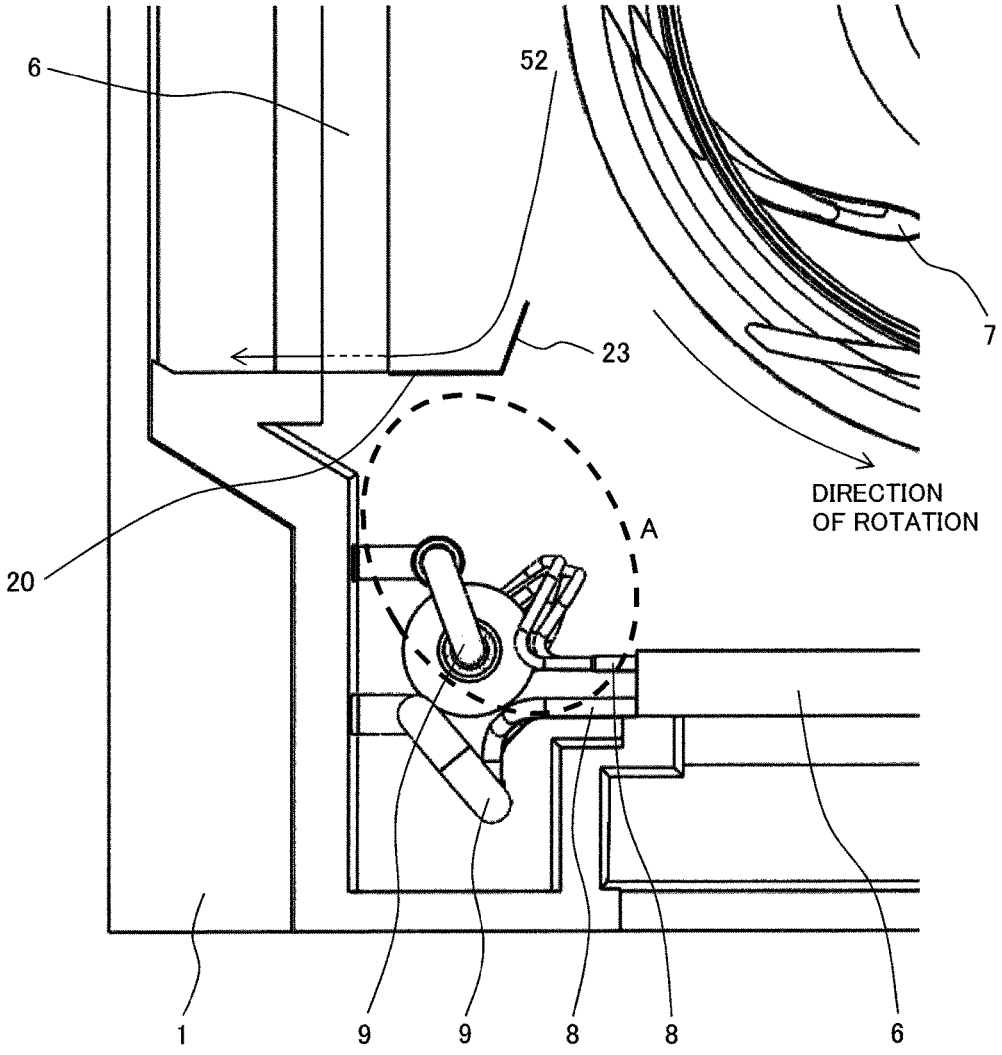
FIG. 6 is a partial enlarged view illustrating an inside of the indoor unit of the air conditioner in a third embodiment.

FIG. 6 illustrates the configuration of the inside of an indoor unit in a third embodiment.

By matching the angle formed by the current plate 20 and the second face 23 with an air flow 52 sent from the centrifugal fan 7, the air flow 52 can be more effectively rectified. When this configuration is also applied to the first embodiment or the second embodiment, the same effect is obtained. When the angle of an air flow 52 varies in the height direction of the heat exchanger 6, the air flow 52 can be more effectively rectified by varying also the angle formed by the current plate 20 and the second face 23 in the height direction of the heat exchanger 6.

Fourth Embodiment

Figure 7:
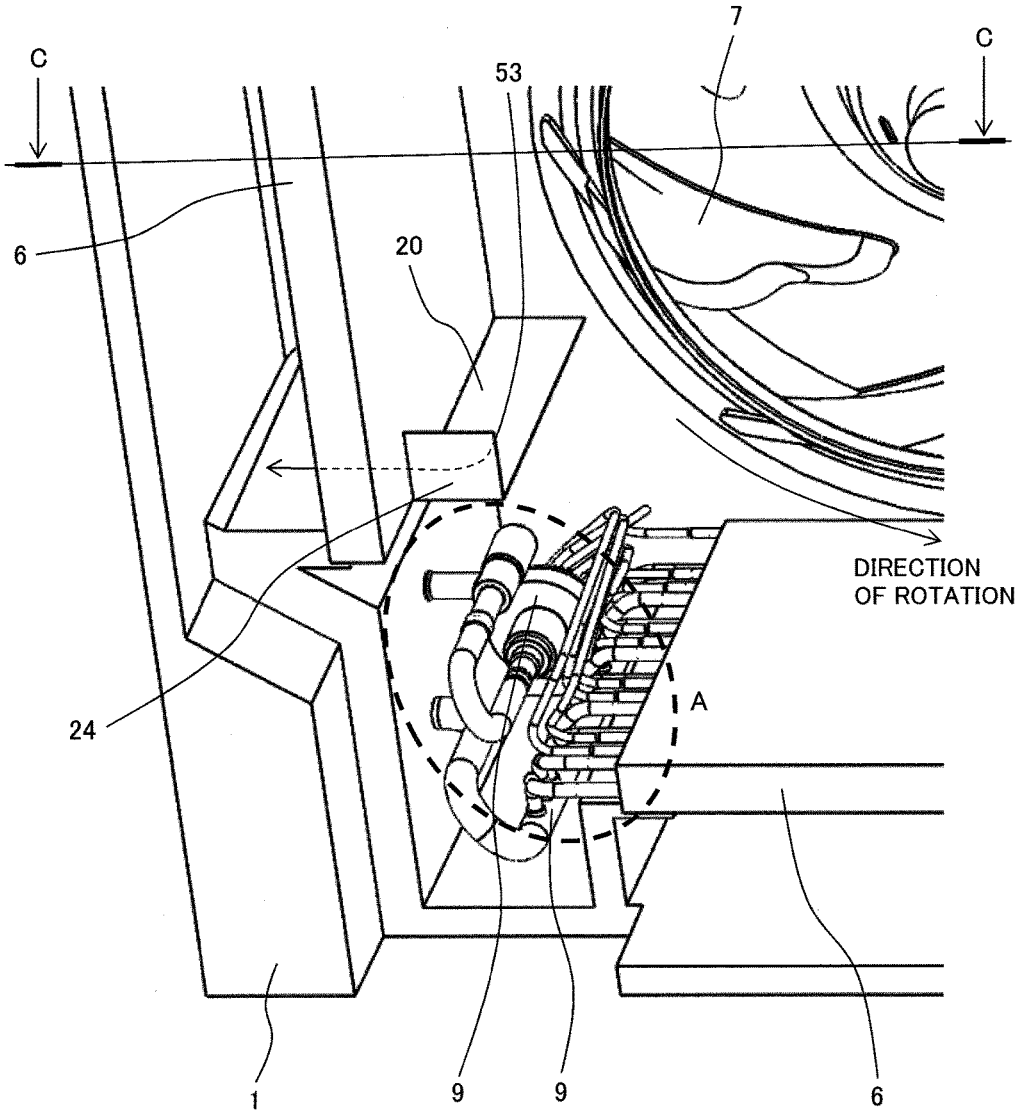
FIG. 7 is a partial perspective view illustrating an inside of the indoor unit of the air conditioner in a fourth embodiment.

FIG. 7 illustrates the configuration of the inside of an indoor unit in a fourth embodiment and a flow field of air sent from the centrifugal fan.

In this embodiment, a second face 24 is provided at the lower end of a current plate 20. The second face 24 is in such a shape that the second plate is extended in a thickness direction of the heat exchanger.

When an air flow 53 sent from the centrifugal fan 7 collides with the current plate 20, the second face 24 suppresses the direction of the air flow from being bent downward and the air flow from surmounting the current plate 20 and entering the space A. In this drawing, the current plate 20 and the second face 24 are orthogonal to each other. Since the inflow of the air flow 53 to the heat exchanger 6 is promoted by the second face 24, the amount of exchanged heat is increased and power consumption can be reduced.

In FIG. 7, the second face 24 is depicted as a flat surface but a second face having a curved surface is also acceptable. The current plate 20 and the second face 24 may also be smoothly connected with each other. The current plate 20 and the second face 24 need not be orthogonal to each other and the angle formed thereby may be acute or may be obtuse.

Fifth Embodiment

Figure 8:
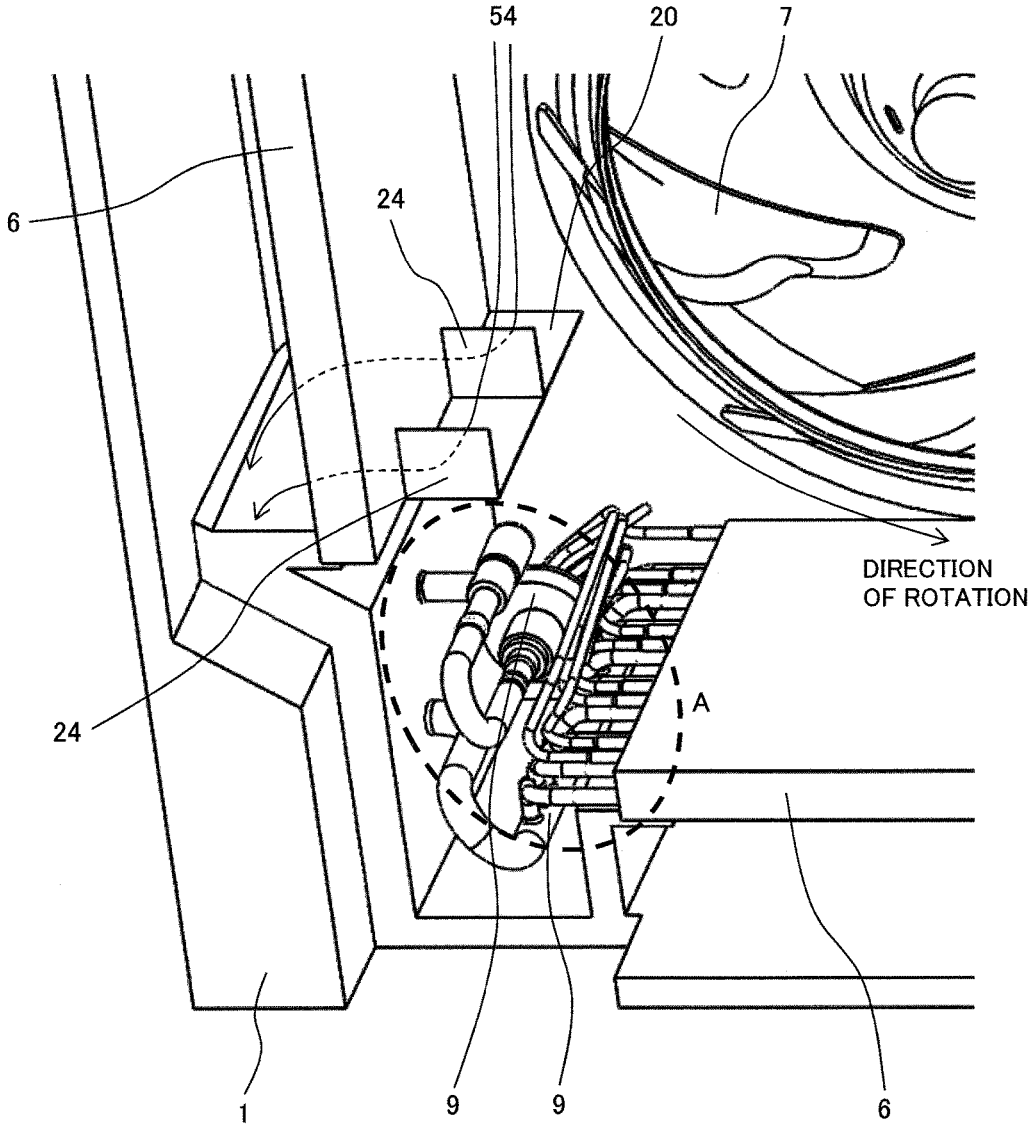
FIG. 8 is a partial perspective view illustrating an inside of the indoor unit of the air conditioner in a fifth embodiment.

FIG. 8 illustrates the configuration of the inside of an indoor unit in a fifth embodiment and a flow field of air sent from the centrifugal fan.

In FIG. 8, a plurality of the second faces 24 shown in relation to the fourth embodiment (FIG. 7) are attached in the height direction of the current plate 20. As a result, an air flow 54 can be dispersed in the height direction of the heat exchanger 6 as compared with cases where a single second face 24 is provided. Owing to this effect, a flow velocity distribution of air passing through the heat exchanger 6 can be uniformized; as a result, a rate of heat exchange between air and the refrigerant is enhanced and power consumption can be reduced.

In FIG. 8, an additional second face 24 is attached to a central part of the current plate 20 in the height direction. The present invention is not limited to this configuration and the additional second face may be attached to the lower part or upper part of the current plate 20 in the height direction. Further, three or more second faces 24 may be attached. In this case, the spacing between the second faces 24 need not be even. As in the fourth embodiment, the second faces 24 may have a curved surface; and the current plate 20 and the second faces 24 need not be orthogonal to each other and the angle formed thereby may be acute or may be obtuse.

Sixth Embodiment

Figure 9:
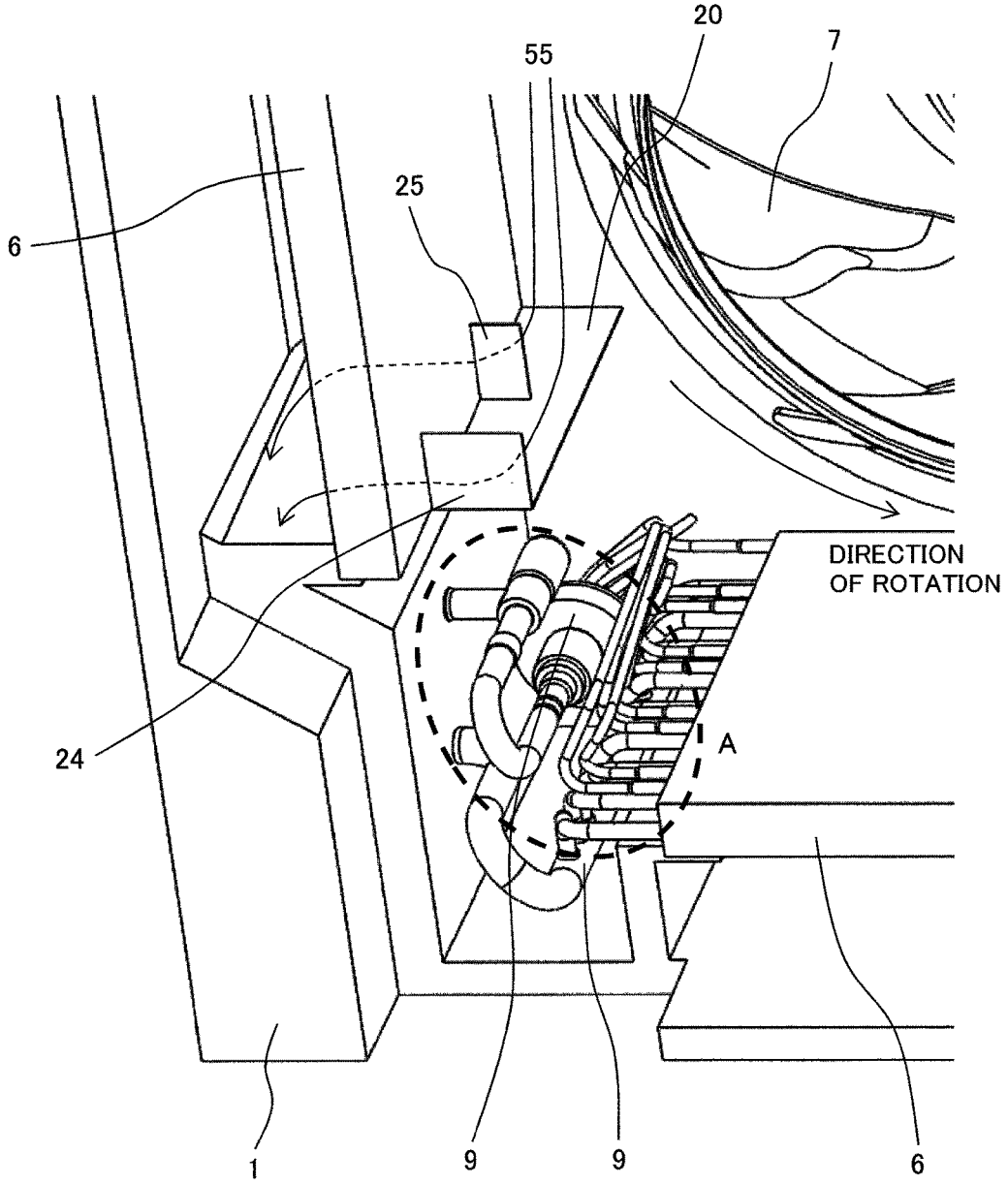
FIG. 9 is a partial perspective view illustrating an inside of the indoor unit of the air conditioner in a sixth embodiment.

FIG. 9 illustrates the configuration of the inside of an indoor unit in a sixth embodiment and a flow field of air sent from the centrifugal fan.

As described in relation to the fifth embodiment (FIG. 8), when a plurality of second faces 24 are attached in the height direction of the current plate 20, the widths of the second faces 24 need not be all identical with the width of the current plate 20.

The second face 25 shown in FIG. 9 is attached to the central part of the current plate 20 in the height direction and its width is smaller than the width of the second face 24 attached to a lower end portion of the current plate 20. When three or more second faces 24 are attached, only one of them may be small like the second face 25.

Similarly, the widths of the second faces 24 may be larger than the width of the current plate 20. This makes it possible to more effectively disperse the air flow 55 in the height direction of the heat exchanger 6 and thus uniformize a flow velocity distribution of air passing through the heat exchanger 6.

Seventh Embodiment

Figure 10:
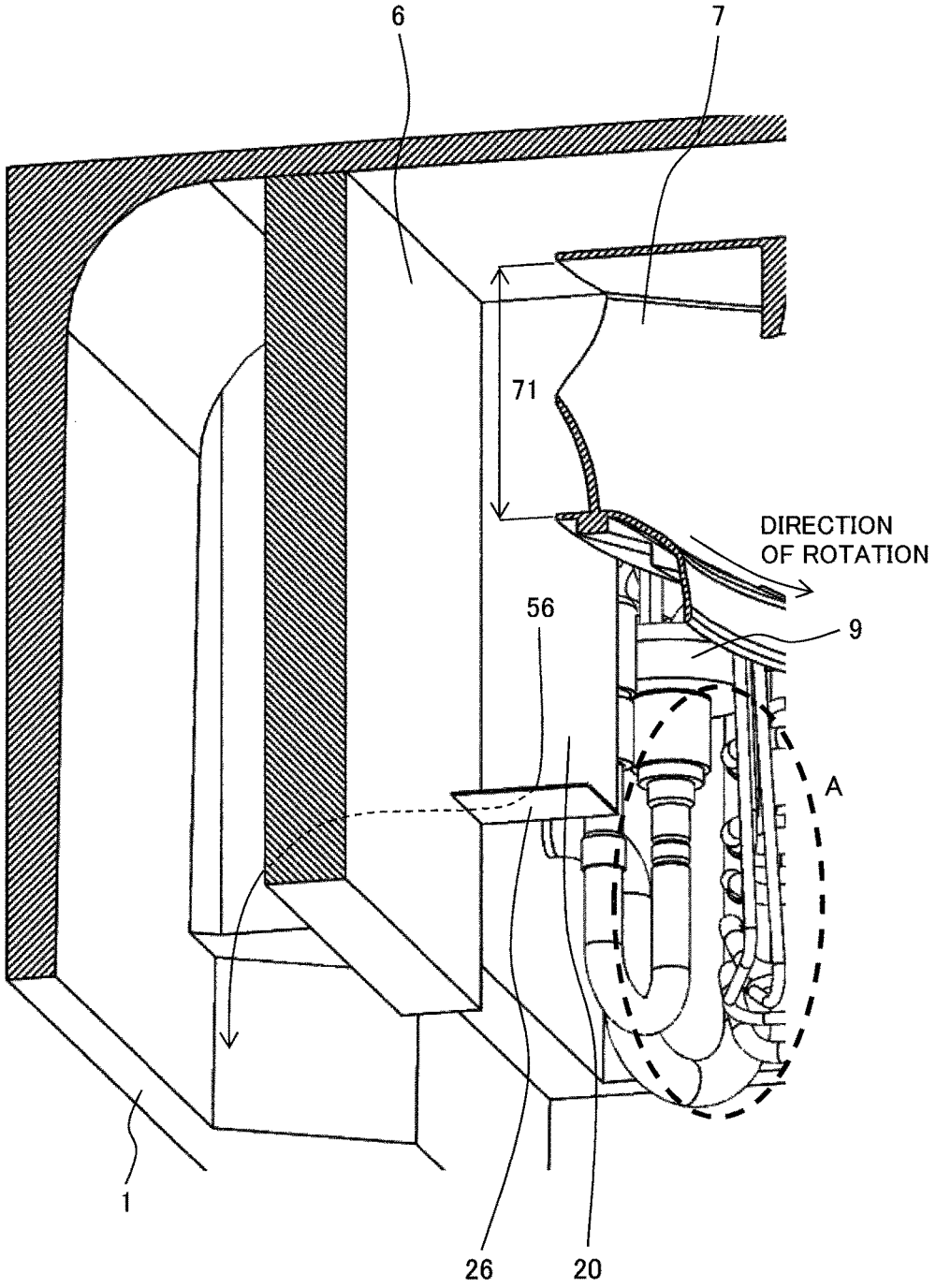
FIG. 10 is a sectional view taken along line C-C of FIG. 7 and illustrates an inside of the indoor unit of the air conditioner in a seventh embodiment.

FIG. 10 is a sectional view taken along line C-C of FIG. 7.

In this embodiment, the position of the second face 24 in the fourth to sixth embodiments is limited. That is, the second face 26 shown in FIG. 10 is placed below a lower end portion of the discharge opening 71 of the centrifugal fan 7. As a result, the amount of an air flow 56, sent from the centrifugal fan 7, entering the space A can be reduced as compared with cases where this configuration is not adopted (cases where the second face 26 is placed above the lower end portion of the discharge opening 71 of the centrifugal fan 7.

As described in relation to the fifth embodiment or the sixth embodiment, when a plurality of second faces are attached, at least one of them only has to be arranged below the discharge opening 71.

Eighth Embodiment

Figure 11:
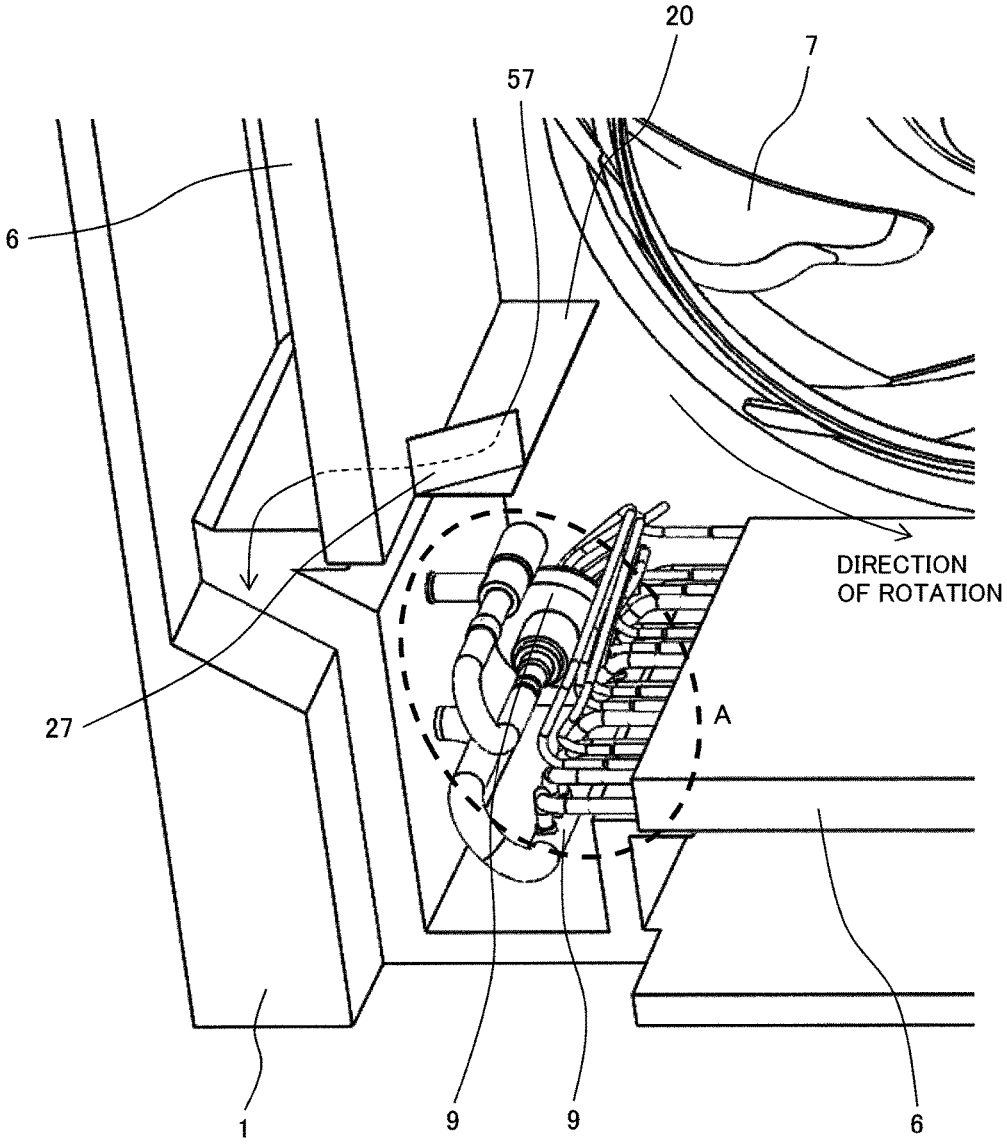
FIG. 11 is a partial perspective view illustrating an inside of the indoor unit of the air conditioner in an eighth embodiment.

FIG. 11 illustrates the configuration of the inside of an indoor unit in the eighth embodiment and a flow field of air sent from the centrifugal fan.

In FIG. 11, a second face 27 is slantly attached to the current plate 20 such that the second face becomes higher as it goes from the heat exchanger 6 to the top of the housing 1. As a result, an air flow 57, sent from the centrifugal fan 7, entering the space A from a side of the current plate 20 can be reduced and the inflow to the heat exchanger 6 can be increased as compared with cases where the second face is not slanted. Since an air flow entering the space A from a side of the current plate 20 can be reduced, loss reduction results and power consumption can be reduced.

Ninth Embodiment

Figure 12:
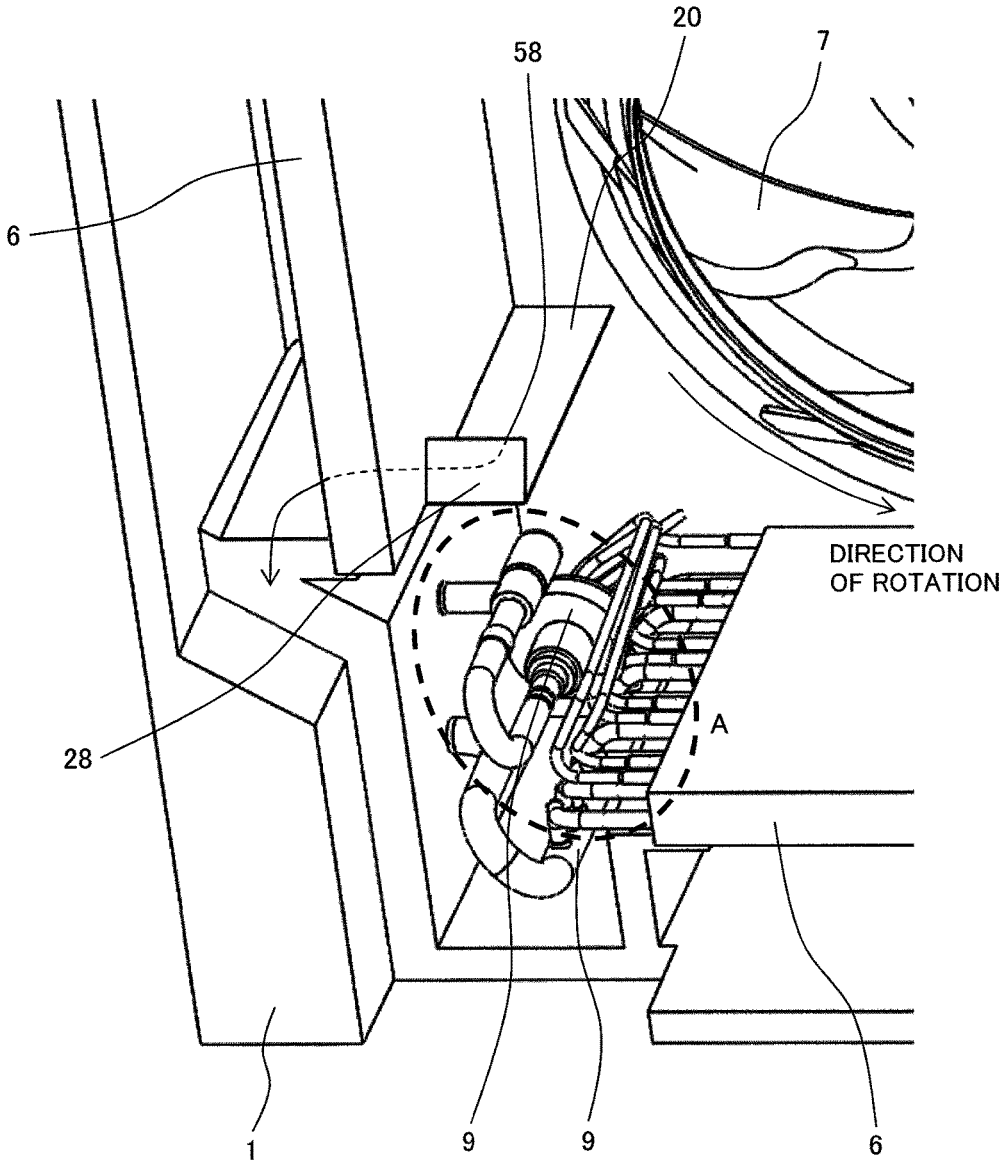
FIG. 12 is a partial perspective view illustrating an inside of the indoor unit of the air conditioner in a ninth embodiment.

FIG. 12 illustrates the configuration of the inside of an indoor unit in a ninth embodiment and a flow field of air sent from the centrifugal fan.

In FIG. 12, a second face 28 is slantly attached to the current plate 20 such that the second face becomes higher as it goes from a final portion of the heat exchanger 6 in the direction of rotation of the centrifugal fan 7 to the top of the housing 1. As a result, an air flow 58, sent from the centrifugal fan 7, entering the space A from the bottom of the current plate 20 can be reduced as compared with cases where the second face is not slanted. When the current plate 20 and the second face 28 are formed by folding a single member, this configuration can be easily implemented and the number of parts can be reduced. This makes it possible to reduce a process cost and the cost of materials.

Figure 13:
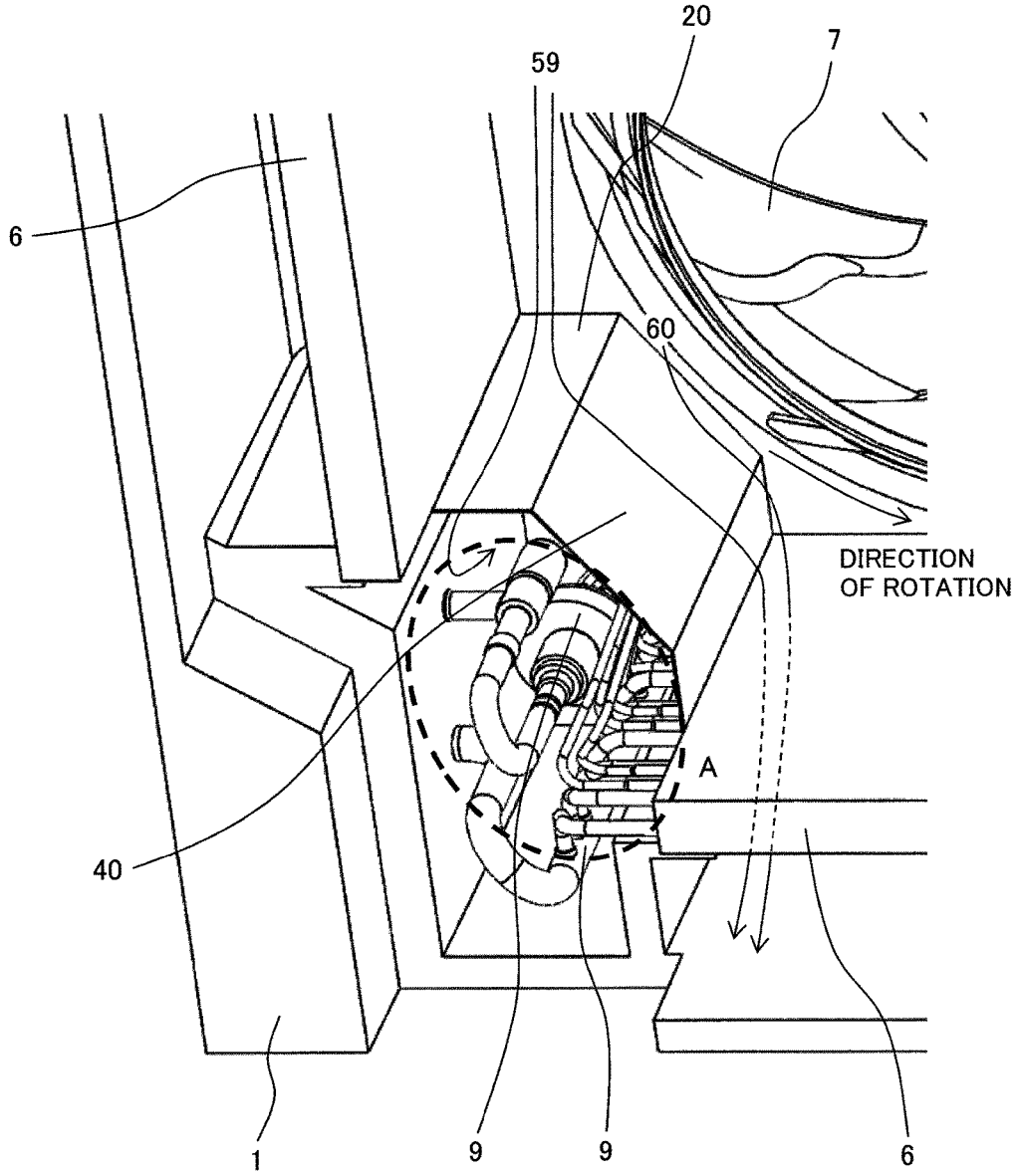
FIG. 13 is a partial perspective view illustrating an inside of the indoor unit of the air conditioner with a partitioning plate attached, to which the present invention is not applied.

FIG. 13 shows an example in which the present invention is not applied and illustrates the inside of the indoor unit of the air conditioner and a flow field of air sent from a centrifugal fan as a partitioning plate is attached. Since the present invention is not applied to this example, the example involves problems described below.

As illustrated in FIG. 13, a partitioning plate 40 could be attached together with the current plate 20 to reduce an air flow entering the space A. The partitioning plate 40 is in such a shape that the partitioning plate connects the current plate 20 and a starting portion of the heat exchanger 6 in the direction of rotation of the centrifugal fan 7 and covers the space A. However, this configuration involves some problems. When an air flow 59 sent from the centrifugal fan 7 collides with the current plate 20 after such a partitioning plate 40 is attached, two air flows are produced: one entering the space A toward the lower part of the current plate 20 and the other going along the partitioning plate 40 to the vicinity of the starting portion of the heat exchanger 6 in the direction of rotation of the centrifugal fan 7. When an air flow enters the space A, a pressure loss occurs in a connecting pipe 8 or a distributor 9 placed in the space A and this leads to a loss of the energy of the air flow.

Meanwhile, the air flow entering the heat exchanger 6 along the partitioning plate 40 meets the air flow 60 sent from the centrifugal fan 7 in proximity to the partitioning plate 40 and enters the heat exchanger 6. For this reason, the air inflow to the vicinity of the starting portion of the heat exchanger 6 in the direction of rotation of the centrifugal fan 7 is larger than those at other points of inflow to the heat exchanger 6. In terms of pressure loss and heat exchange efficiency, it is desirable that the inflow to the heat exchanger 6 be even regardless of the point of inflow. In consideration of the foregoing, only attaching the partitioning plate 40 makes it possible to reduce an air flow entering the space A from a side of the current plate 20 but makes the inflow to the heat exchanger 6 uneven and increases the power consumption of the air conditioner.

Tenth Embodiment

Figure 14:
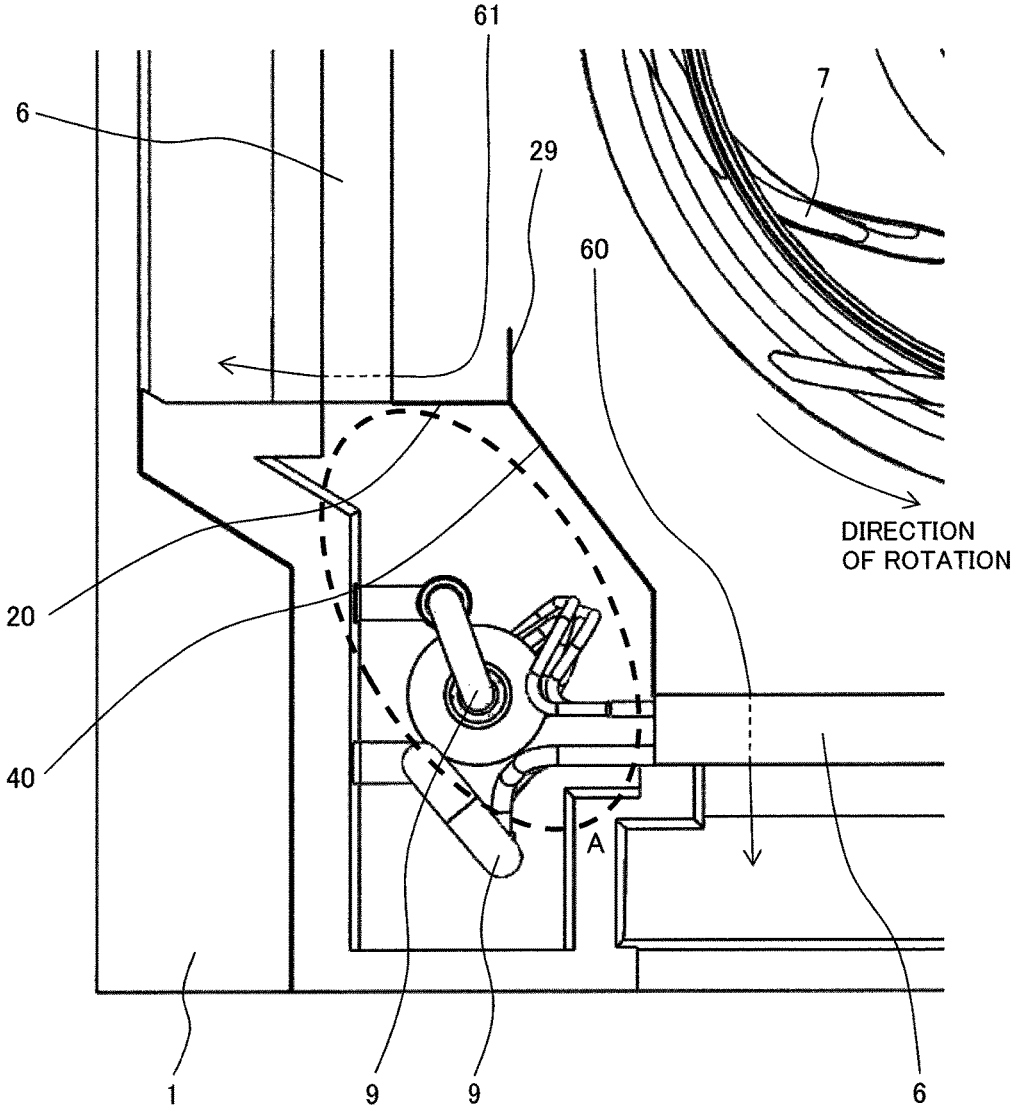
FIG. 14 is a partial enlarged view illustrating an inside of the indoor unit of the air conditioner in a tenth embodiment.

FIG. 14 illustrates the configuration of the inside of an indoor unit in a tenth embodiment and a flow field of air sent from the centrifugal fan.

In FIG. 14, a second face 29 is attached between the current plate 20 (first face) and the partitioning plate 40 (at an end of the current plate 20). In other words, the current plate 20 (first face) is formed as a part of the partitioning plate 40. As a result, when an air flow 61 sent from the centrifugal fan 7 collides with the current plate 20, the air flow along the partitioning plate 40 is reduced by the second face 29 and the inflow to the heat exchanger 6 is thereby promoted. This makes it possible to reduce the flow rate of the air flow 60 and reduce the air inflow to the vicinity of the starting portion of the heat exchanger 6 in the direction of rotation of the centrifugal fan 7 as well. Therefore, the inflow to the heat exchanger 6 is made near even. Even when any of the shapes in the first to third embodiments is adopted as the shape of the second face 29, the same effect is obtained.

Eleventh Embodiment

Figure 15:
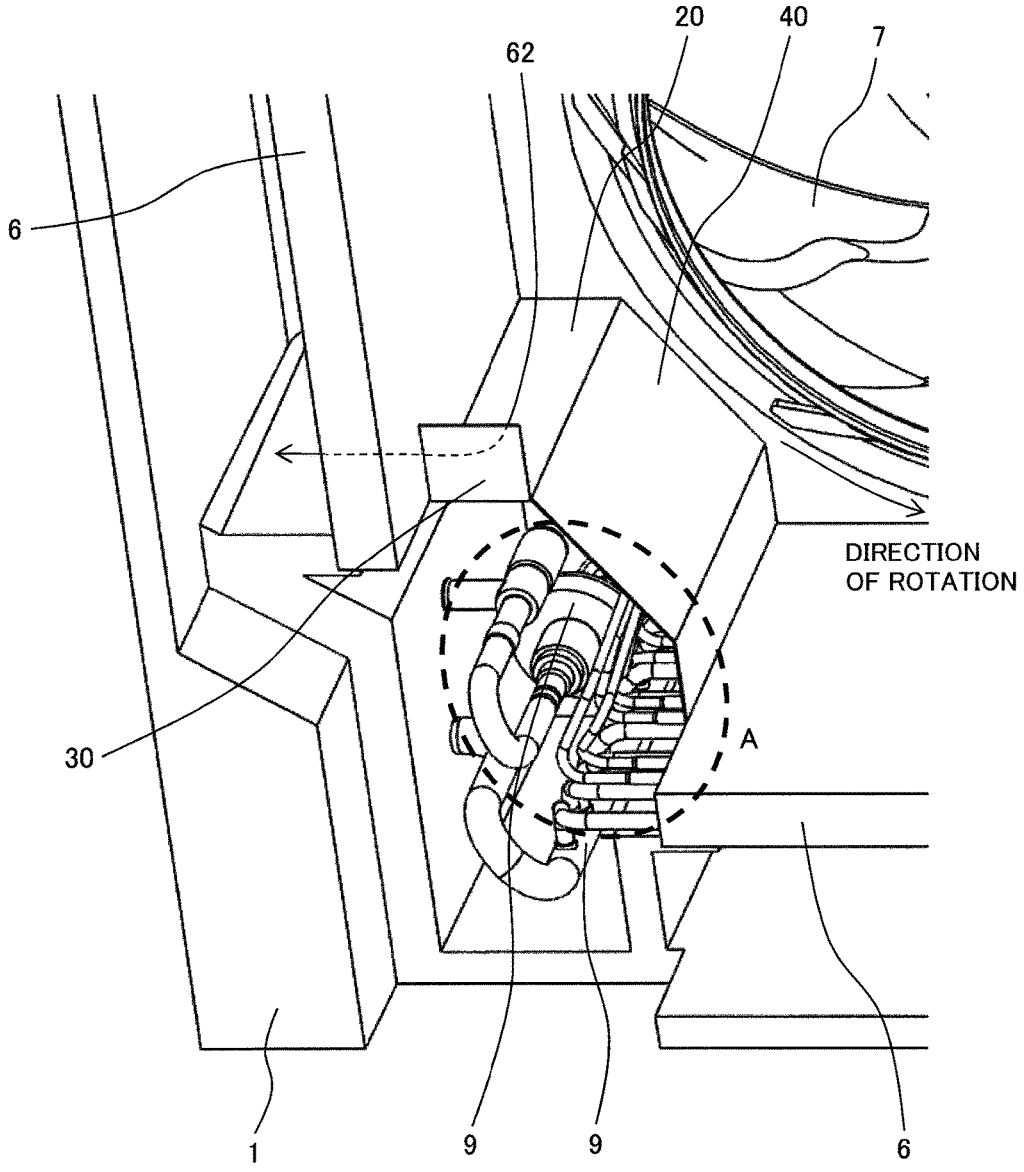
FIG. 15 is a partial perspective view illustrating an inside of the indoor unit of the air conditioner in an eleventh embodiment.

FIG. 15 illustrates the configuration of the inside of an indoor unit in an eleventh embodiment and a flow field of air sent from the centrifugal fan.

In FIG. 15, a second face 30 is attached to the lower end of the current plate 20. As a result, the following event can be suppressed. That is, an air flow 62 sent from the centrifugal fan 7 collides with the current plate 20 and the direction of the air flow is bent downward regardless of the presence or absence of the partitioning plate 40. The air flow then surmounts the lower part of the current plate 20 and entering the space A. This can be suppressed. Further, the inflow to the heat exchanger 6 can be promoted and the inflow to the space A can be reduced; therefore, power consumption can be reduced. Even when any of the shapes in the fourth to tenth embodiments is adopted as the shape of the second face 30, the same effect is obtained.

In the description of the above embodiments, indoor units equipped with a heat exchanger including a space where a connecting pipe and a distributor are arranged and a fan have been taken as examples. The present invention is applicable to indoor units with a fan and a heat exchanger placed therein in which indoor units, there is a space formed by the heat exchanger being cut in the circumferential direction and an energy loss is caused by disturbance of a flow in the space even though a connecting pipe or a distributor is not arranged in the space.

DESCRIPTION OF REFERENCE NUMERALS

1: Housing
2: Panel
3: Grille
4: Air outlet
5: Louver
6: Heat exchanger
7: Centrifugal fan
8: Connecting pipe
9: Distributor
20: Current plate
21, 22, 23, 24, 25, 26, 27, 28, 29, 30: Second face
40: Partitioning plate
71: Discharge opening of centrifugal fan

What is claimed is:

1. An indoor unit of an air conditioner comprising:
a housing;
a centrifugal fan arranged inside the housing; and
a heat exchanger arranged so as to surround the centrifugal fan,
wherein the heat exchanger includes an area cut in a direction of rotation of the centrifugal fan,
wherein a current plate is provided at a final portion of the heat exchanger in the direction of the rotation of the centrifugal fan, and
wherein the current plate includes a first face that extends away from the heat exchanger and toward the centrifugal fan and that blocks an air flow produced between the centrifugal fan and the heat exchanger and a second face that protrudes from only a portion of an end of the first face to extend in a height direction of the heat exchanger and in a direction opposite the air flow.

2. The indoor unit of the air conditioner according to claim 1,
wherein the second face faces an inner surface of the heat exchanger that faces the centrifugal fan and is parallel to the inner surface of the heat exchanger.

3. The indoor unit of the air conditioner according to claim 2,
wherein a height of the second face is equal to or higher than at least half a height of a discharge opening of the centrifugal fan, and
wherein an attaching position of the second face or at least a part of the second face is in the same position of the discharge opening of the centrifugal fan.

4. The indoor unit of the air conditioner according to claim 2, wherein an angle formed by the first face and the second face is matched with an angle of air blow out from the centrifugal fan.

5. An air conditioner comprising:

the indoor unit of the air conditioner according to claim 1;

an outdoor unit including a compressor; and a refrigerant pipe connecting between the indoor unit and the outdoor unit.

* * * * *